US009848667B2

(12) United States Patent
Brace et al.

(10) Patent No.: US 9,848,667 B2
(45) Date of Patent: Dec. 26, 2017

(54) LENS SEAL FOR HEADGEAR

(75) Inventors: Thomas J. Brace, St. Paul, MN (US); Sean R. Kilmer, Lino Lakes, MN (US); Alan J. Solyntjes, Edina, MN (US); Steven W. Stavos, Blaine, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1561 days.

(21) Appl. No.: 12/934,282

(22) PCT Filed: Mar. 30, 2009

(86) PCT No.: PCT/US2009/038733

§ 371 (c)(1),
(2), (4) Date: Sep. 24, 2010

(87) PCT Pub. No.: WO2009/123947

PCT Pub. Date: Oct. 8, 2009

(65) Prior Publication Data

US 2011/0016595 A1 Jan. 27, 2011

Related U.S. Application Data

(60) Provisional application No. 61/042,309, filed on Apr. 4, 2008.

(51) Int. Cl.

| | |
|---|---|
| ***A42B 3/00*** | (2006.01) |
| ***A42B 3/22*** | (2006.01) |
| *A62B 18/08* | (2006.01) |

(52) U.S. Cl.
CPC ..... *A42B 3/225* (2013.01); *A62B 18/082* (2013.01); *Y10T 29/4998* (2015.01)

(58) Field of Classification Search
USPC .... 2/15, 424, 2.17, 443, 442, 439, 432, 435, 2/436
See application file for complete search history.

(56) References Cited

U.S. PATENT DOCUMENTS

| | | | | |
|---|---|---|---|---|
| 2,903,700 | A * | 9/1959 | Finken et al. | 2/10 |
| 2,936,458 | A * | 5/1960 | Luisada | 2/435 |
| 3,037,236 | A | 6/1962 | Miller | |
| 3,362,403 | A * | 1/1968 | Fleming et al. | 128/201.24 |
| 3,534,408 | A * | 10/1970 | Fifield | 2/2.17 |

(Continued)

FOREIGN PATENT DOCUMENTS

| | | |
|---|---|---|
| CA | 2162227 | 6/1995 |
| CA | 2549501 A | 5/1999 |

(Continued)

*Primary Examiner* — Richale Quinn

(57) ABSTRACT

An article of headgear that has a head-covering article, a lens moveably attached to the head-covering article, and a seal attached to the lens, the seal comprising a first polymeric material and a second polymeric material, the first polymeric material having a greater tensile modulus than the second material. In an exemplary embodiment, the lens is moveable from a first, lowered position to a second, raised position, and when in the first, lowered position, the seal sealingly engages the head-covering article. In some embodiments, the tensile modulus of the first polymeric material is at least about 5× greater or even about 10× greater than the tensile modulus of the second material.

12 Claims, 6 Drawing Sheets

(56) References Cited

U.S. PATENT DOCUMENTS

| | | | | |
|---|---|---|---|---|
| 3,691,565 | A * | 9/1972 | Galonek | 2/431 |
| 4,015,295 | A * | 4/1977 | Lancaster et al. | 2/2.15 |
| 4,070,712 | A * | 1/1978 | Marwitz | 2/10 |
| 4,315,335 | A * | 2/1982 | Kennedy et al. | 2/424 |
| 4,449,255 | A * | 5/1984 | Dodd | 2/428 |
| 4,606,670 | A * | 8/1986 | Angell | 403/291 |
| 4,756,784 | A | 7/1988 | Jones et al. | |
| 4,764,990 | A * | 8/1988 | Markert | 2/429 |
| 4,766,609 | A | 8/1988 | Lane | |
| 5,509,670 | A | 4/1996 | Wheeler | |
| 5,575,278 | A | 11/1996 | Bonhomme | |
| 5,697,108 | A * | 12/1997 | Culbertson, Jr. | 2/457 |
| 5,794,260 | A * | 8/1998 | Schegerin | 2/6.1 |
| 6,006,355 | A * | 12/1999 | Abts | 2/2.11 |
| 6,035,451 | A * | 3/2000 | Burns et al. | 2/424 |
| 6,161,225 | A * | 12/2000 | Arai | 2/424 |
| 6,298,498 | B1 * | 10/2001 | Burns et al. | 2/424 |
| 6,308,330 | B1 * | 10/2001 | Hollander et al. | 2/9 |
| 6,324,703 | B1 * | 12/2001 | Chen | 2/458 |
| 6,371,116 | B1 * | 4/2002 | Resnick | 128/206.24 |
| 6,397,847 | B1 * | 6/2002 | Scarberry et al. | 128/206.24 |
| 6,718,561 | B2 * | 4/2004 | Dondero | 2/436 |
| 6,795,979 | B2 * | 9/2004 | Fournier | 2/424 |
| 7,051,732 | B2 | 5/2006 | Uusitalo | |
| 7,197,774 | B2 * | 4/2007 | Curran et al. | 2/441 |
| 7,313,829 | B1 * | 1/2008 | Serra et al. | 2/2.15 |
| 7,549,180 | B2 * | 6/2009 | Matsumoto et al. | 2/436 |
| 2002/0157175 | A1 * | 10/2002 | Dondero | 2/436 |
| 2003/0070200 | A1 * | 4/2003 | Crye et al. | 2/6.6 |
| 2003/0110552 | A1 * | 6/2003 | Youmans et al. | 2/426 |
| 2003/0188368 | A1 * | 10/2003 | Stinton | 2/2.16 |
| 2004/0221375 | A1 * | 11/2004 | Douglas | 2/424 |
| 2006/0119948 | A1 * | 6/2006 | Matsumoto et al. | 359/624 |
| 2007/0083007 | A1 | 4/2007 | Jacob | |
| 2010/0175160 | A1 * | 7/2010 | Arnold | 2/15 |
| 2011/0016595 | A1 * | 1/2011 | Brace et al. | 2/15 |

FOREIGN PATENT DOCUMENTS

| | | | |
|---|---|---|---|
| EP | 0 781 515 | A1 | 7/1997 |
| EP | 1 847192 | | 10/2007 |
| GB | 2 061 696 | | 5/1981 |
| GB | 2298778 | A | 9/1996 |
| JP | 62-97132 | | 6/1987 |
| JP | 4-39206 | | 4/1992 |
| JP | 06-093249 | | 12/1996 |
| JP | 2002-506142 | | 2/2002 |
| JP | 03128719 | | 12/2006 |
| WO | 96/28987 | | 9/1996 |
| WO | 99/45808 | A1 | 9/1999 |
| WO | WO 01/79737 | | 10/2001 |
| WO | 2005/068021 | | 7/2005 |

* cited by examiner

LENS SEAL FOR HEADGEAR

CROSS REFERENCE TO RELATED APPLICATIONS

This application is a national stage filing under 35 U.S.C. 371 of PCT/US2009/038733, filed Mar. 30, 2009, which claims priority to United States Provisional Application No. 61/042,309, filed Apr. 4, 2008, the disclosure of which is incorporated by reference in its/their entirety herein.

FIELD OF THE DISCLOSURE

The present disclosure is directed to headgear having a movable face shield and lens, in particular, to headgear having a lens sealingly engaging the headgear.

BACKGROUND OF THE DISCLOSURE

One common type of headgear is a respirator system. Respirator systems are frequently worn by people working in areas where the air may be contaminated with toxic or noxious substances such as particulates, gases and vapors. For example, the air in a sanding or grinding area may contain airborne particulates, the air in a painting area may contain droplets of paint or solvent vapors, and the air in a welding area may contain harmful particles or fumes. The respirator system may filter the air or it may provide a supply of uncontaminated air.

A respirator system may include a helmet, hardhat or similar device for impact protection. Respirator systems that include helmets are frequently worn by people working in areas where there is a potential for impact from a foreign object. Typically, this type of respirator system includes a helmet, hardhat or another impact resistant head cover with an air inlet, face shield, and a clean air supply.

When the respirator system is in use with the face shield lowered, the face shield should form a tight seal to inhibit passage of contaminants, both particulate and gaseous, into the wearer's air space. Often while being worn, but when the respirator system is not in use, there is a desire by the user to remove the face shield from the field of view. Many face shields are pivotally attached to the head cover, to allow the face shield to be lifted when it is not needed.

What is needed is a respirator system that provides good sealing when the respirator system is in use with the face shield lowered, but that also allows the face shield to be lifted when desired.

BRIEF SUMMARY OF THE DISCLOSURE

In one particular aspect, this disclosure is directed to an article of headgear that has a head-covering article, a lens moveably attached to the head-covering article, and a seal attached to the lens, the seal comprising a first polymeric material and a second polymeric material, the first polymeric material having a greater tensile modulus than the second material.

In another particular aspect, this disclosure is directed to an article of headgear having a head-covering article, a lens moveably attached to the head-covering article, the lens having a curve associated therewith, and a seal attached to the lens, the seal being curved and comprising a first polymeric material and a second polymeric material, the first polymeric material having a greater tensile modulus than the second material.

In another particular aspect, this disclosure is directed to a method of making an article of headgear. The method includes providing a head-covering article, pivotally connecting to the head-covering article a lens, extruding a polymeric material to form a seal, post-forming the extruded seal to form a curved seal; and mechanically attaching the curved seal to the lens.

In yet another particular aspect, this disclosure is directed to a method of making an article of headgear. The method includes providing a head-covering article, pivotally connecting to the head-covering article a lens, extruding a first polymeric material and a second polymeric material to form a seal, the first polymeric material having a greater tensile modulus than the second material, and mechanically attaching the seal to the lens.

DETAILED DESCRIPTION OF THE DISCLOSURE

In the following description, reference is made to the accompanying set of drawings that form a part hereof and in which are shown by way of illustration several specific embodiments. It is to be understood that other embodiments are contemplated and may be made without departing from the scope or spirit of the present invention. The following detailed description, therefore, is not to be taken in a limiting sense. While the present invention is not so limited, an appreciation of various aspects of the invention will be gained through a discussion of the examples provided below.

The present disclosure is directed to articles of headgear, such as respirator systems, which may include a face shield movable from a first, lowered position to a second, raised position. The face shield includes a lens having a seal at its top edge that sealingly engages the surface of the headgear when the face shield is in its lowered or closed position. In some embodiments, the seal is fluid tight, e.g., air tight. The seal present between the face shield and the head-covering article may be curved or radiused, to follow the contours of the face shield and the head-covering article. Such a face shield and seal is particularly suited for use with respirator systems.

Various embodiments are provided below of seals, such as extruded seals, that inhibit puckering when formed to a radiused shape, such as a curved shape. Also provided below are various embodiments of seals, such as extruded seals, that sealingly conform to a radiused surface and/or when mounted to a radiused lens. In some embodiments, the seals are composed of at least two different polymeric materials, the materials having different tensile modulus. In other embodiments, the seals are thermally post-processed. The seals engage their sealing surface with minimal puckering that might provide an unsealed area.

Figure 1A:
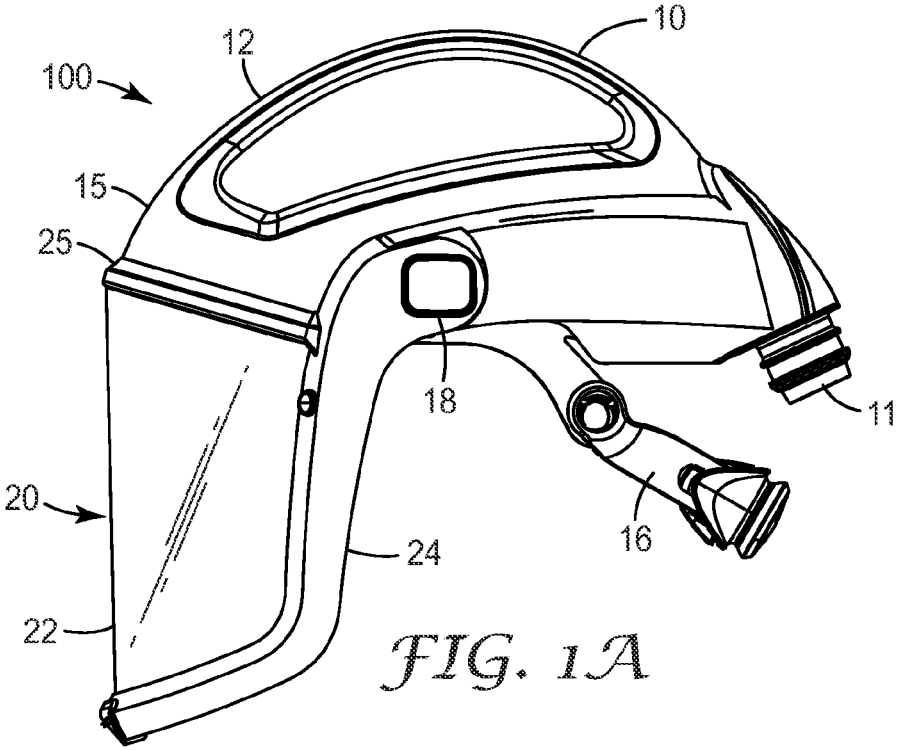
FIG. 1A is a side view of a hardhat respirator system according to the present disclosure, with the lens of the hardhat in a first, closed, position.
Figure 1B:
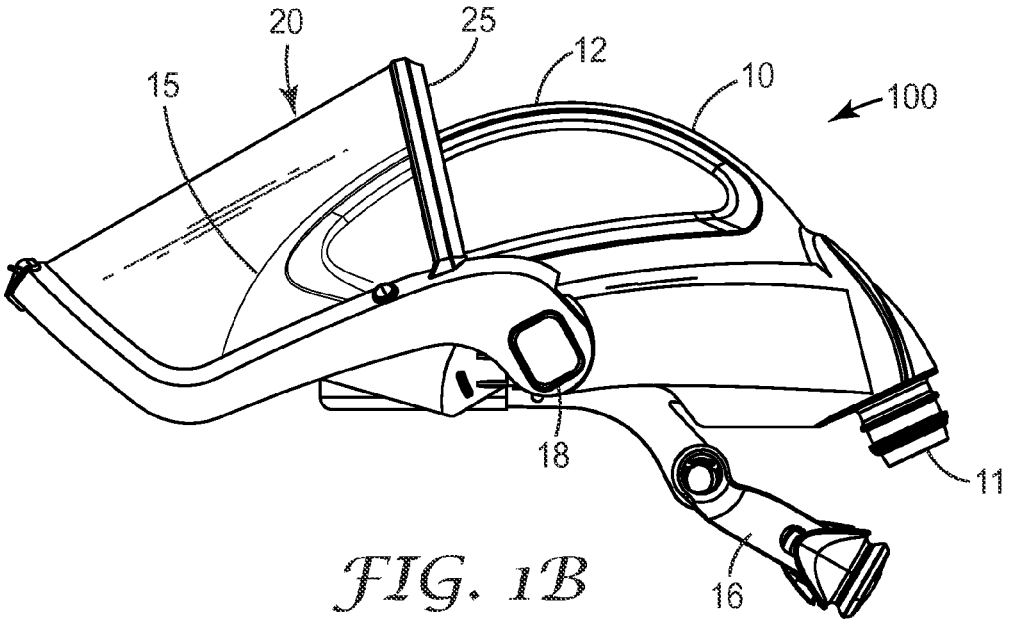
FIG. 1B is a side view of the hardhat respirator system of FIG. 1A with the lens in a second, open, position.

Referring to the figures, a first embodiment of an article of headgear according to this disclosure is illustrated in FIGS. 1A and 1B. The particular article of headgear illustrated is an embodiment of a hardhat respirator system 100. Hardhat respirator system 100 includes a head-protecting head-covering article or shell 10 with a moveable face shield 20 pivotally attached thereto. FIG. 1A illustrates face shield 20 in a first, closed or lowered position, configured for protecting the user's face. FIG. 1B illustrates face shield 20 in a second, open or raised position. Hardhat respirator system 100 includes an air inlet 11, configured to be connected to an air supply for providing a source of breathing air, such as purified air, to the user of hardhat respirator system 100 and an outlet (not shown) configured to be disposed proximate a user's face when the respirator system 100 is worn.

Shell 10 of hardhat respirator system 100 has an outer surface 12, typically configured to resist impact. Shell 10 extends over the user's head and includes a frontal area surface 15. A suspension system 16, e.g., an adjustable suspension system, secures hardhat respirator system 100 to the user's head. In this exemplary embodiment, face shield 20 is pivotally attached to shell 10 via pivot mechanism 18. Face shield 20 has a generally curved lens 22 and a lens frame 24. Lens frame 24 supports lens 22 and allows pivoting of face shield 20 via pivot mechanism 18. Lens 22 may be attached to the head-covering article or shell 10 using the lens frame 24. Face shield 20 includes a seal 25. Seal 25 typically engages, e.g., sealingly engages, frontal area surface 15 of shell 10 when face shield 20 is in its lowered or closed position (FIG. 1A). In some embodiments, the seal may be fluid tight, e.g., air tight. When face shield 20 is in a raised or open position (FIG. 1B), seal 25 usually does not contact shell 10 but other configurations are possible.

Figure 2A:
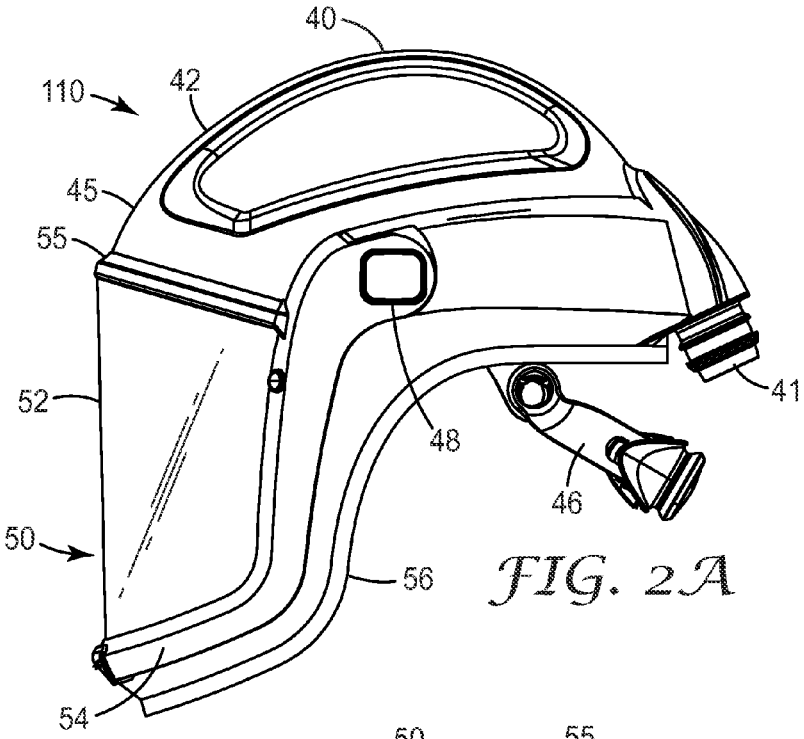
FIG. 2A is a side view of a helmet respirator system according to the present disclosure, with the lens of the helmet in a first, closed, position.
Figure 2B:
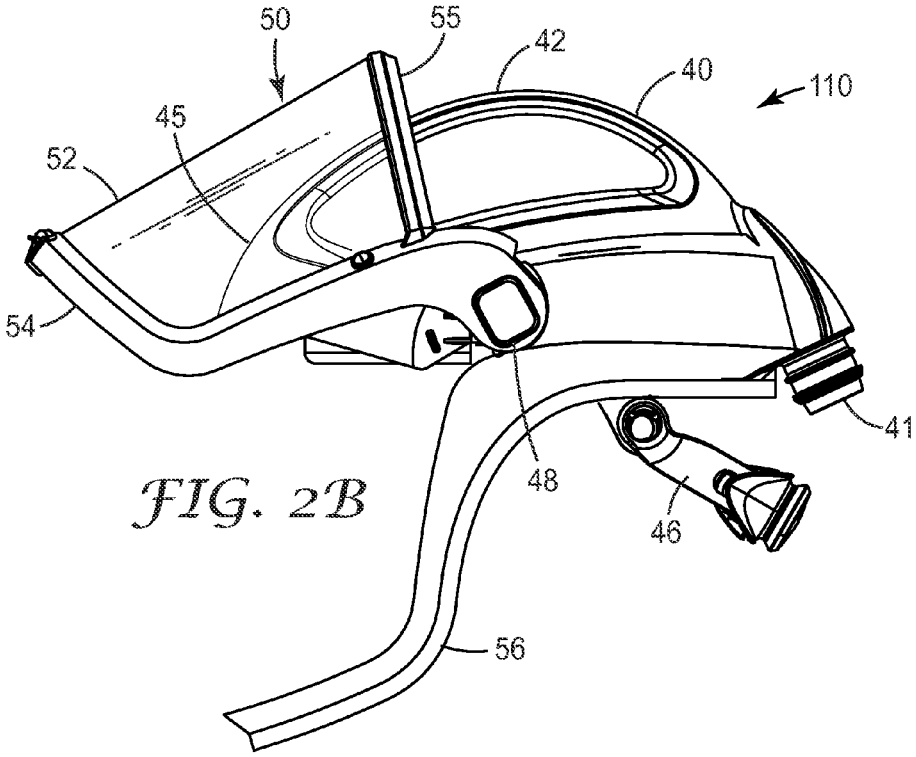
FIG. 2B is a side view of the helmet respirator system of FIG. 2A with the lens in a second, open, position.

A second embodiment of an article of headgear according to this disclosure is illustrated in FIGS. 2A and 2B. The particular article of headgear illustrated is an embodiment of a helmet respirator system 110. Helmet respirator system 110 includes a head-covering article or head-protecting shell 40 with a moveable face shield 50 pivotally attached thereto. FIG. 2A illustrates face shield 40 in a first, closed or lowered position, configured for protecting the user's face. FIG. 2B illustrates face shield 50 in a second, open or raised position. Helmet respirator system 110 includes an air inlet 41, configured to be connected to an air supply for providing a source of breathing air, such as filtered air, to the user of helmet respirator system 110 and an outlet (not shown) configured to be disposed proximate a user's face when the respirator system 110 is worn.

Shell 40 of helmet respirator system 110 has an outer surface 42, typically configured to resist impact. Shell 40 extends over the user's head and includes a frontal area surface 45. A suspension system 46, e.g., an adjustable suspension system, secures helmet respirator system 110 to the user's head. Face shield 50 is pivotally attached to shell 40 via pivot mechanism 48. Face shield 50 has a generally curved lens 52 and a lens frame 54. Lens frame 54 supports lens 52 and allows pivoting of face shield 50 via pivot mechanism 48. Lens 52 may be attached to the head-covering article or shell 40 using the lens frame 54. Face shield 50 includes a seal 55 on lens 52. Seal 55 engages, e.g., sealingly engages, frontal area surface 45 of shell 40 when face shield 50 is in its lowered or closed position (FIG. 2A). In some embodiments, the seal is fluid tight, e.g., air tight. When face shield 50 is in a raised or open position (FIG. 2B), seal 55 usually does not contact shell 40, but other configurations are possible. Fixedly positioned in relation to shell 40 is a jaw frame 56. When closed (i.e., as in FIG. 2A), lens frame 54 contacts and usually seals against jaw frame 56.

Figure 3:
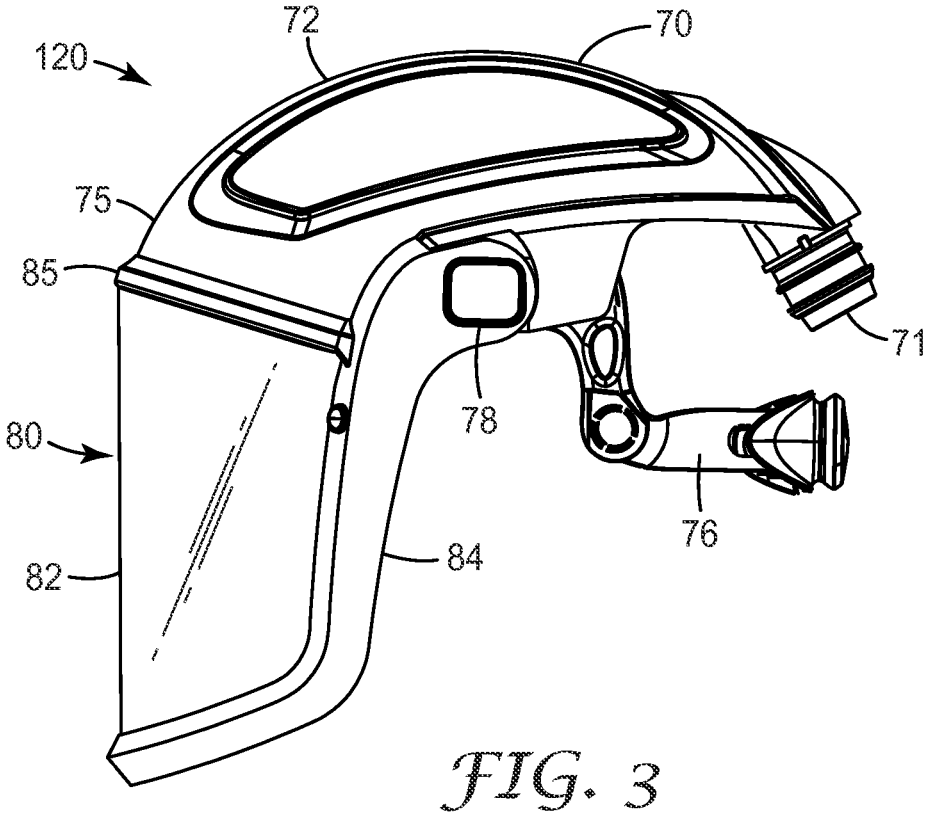
FIG. 3 is a side view of a visor respirator system according to the present disclosure, with the lens of the visor in a first, closed, position.

A third embodiment of an article of headgear according to this disclosure is illustrated in FIG. 3. The particular article of headgear illustrated is an embodiment of a visor respirator system 120. Visor respirator system 120 includes a head covering article or shell 70, that although it covers a portion of the user's head, it is not intended to provide as high of a degree of impact protection as the previously described embodiments. Pivotally connected to shell 70 via mechanism 78 is a moveable face shield 80. Visor respirator system 120 includes an air inlet 71, configured to be connected to an air supply for providing a source of breathing air, such as purified air, to the user of visor respirator system 120 and an outlet (not shown) configured to be disposed proximate a user's face when the respirator system 120 is worn.

Shell 70 of visor respirator system 120 has an outer surface 72 and extends over the user's head and includes a frontal area surface 75. A suspension system 76, e.g., an adjustable suspension system, secures visor respirator system 120 to the user's head. Face shield 80 is pivotally attached to shell 70 via pivot mechanism 78. Face shield 80 has a generally curved lens 82 and a lens frame 84 that supports lens 82 and allows pivoting of face shield 80 via pivot mechanism 78. Lens 82 may be attached to the head-covering article or shell 70 using the lens frame 84. Face shield 80 includes a seal 85 on lens 82. Seal 85 engages, e.g., sealingly engages, frontal area surface 75 of shell 70 when face shield 80 is in its lowered or closed position. In some embodiments, the seal is fluid tight, e.g., air tight. When face shield 80 is in a raised or open position, seal 85 does not contact shell 70, although other configurations are possible.

Figure 4:
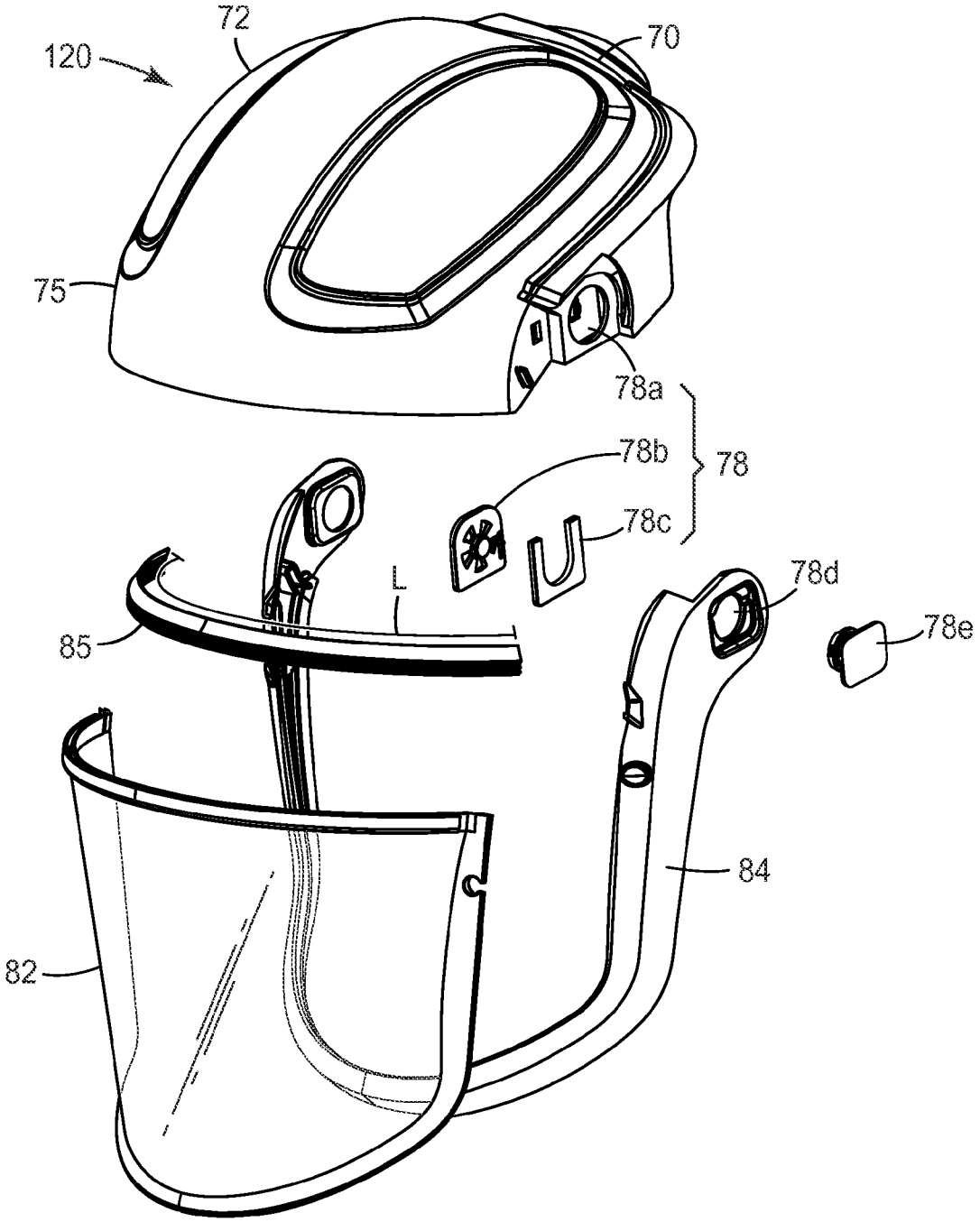
FIG. 4 is an exploded perspective view of the visor respirator system of FIG. 3, illustrating various elements of the system.

FIG. 4 illustrates visor respirator system 120 with various pieces exploded to provide a better understanding of the construction of visor respirator system 120 and also of hardhat respirator system 100 and helmet respirator system 110. Illustrated in FIG. 4 are shell 70 and its outer surface 72 including frontal area surface 75, lens 82 and lens frame 84, and seal 85. Also illustrated are the various pieces of an exemplary pivot mechanism 78. Shell 70 includes an engagement region 78*a* which includes an aperture through shell 70. Positioned on the inside of shell 70 is a cam socket 78*b* that seats within engagement region 78*a* and that extends into the aperture. Lens frame 84 includes an aperture 78*d* therethrough that forms a pivot axis for face shield 80 (FIG. 3). A cam post 78*e* passes through aperture 78*d* in lens frame 84 and through the aperture in engagement region 78*a* of shell 70 and engages with cam socket 78*b*. A spring 78*c*, in this embodiment, is positioned within engagement region 78*a* in shell 70 between a flange on post 78*e* and an inner surface of the aperture in shell 70. Other exemplary embodiments may include completely different pivoting mechanisms, or pivoting mechanisms having different pieces, e.g., different springs 78*c* or different posts 78*e* and sockets 78*b*.

Each of the headgear respirator systems discussed above (i.e., hardhat respirator system 100, helmet respirator system 110 and visor respirator system 120) includes a seal on the face shield lens that forms a seal (e.g., a fluid tight seal) against the shell of the headgear. The following discussion provides various embodiments of seals suitable for use in articles of headgear according to the present disclosure, particularly for those that have a curved lens.

Figure 5:
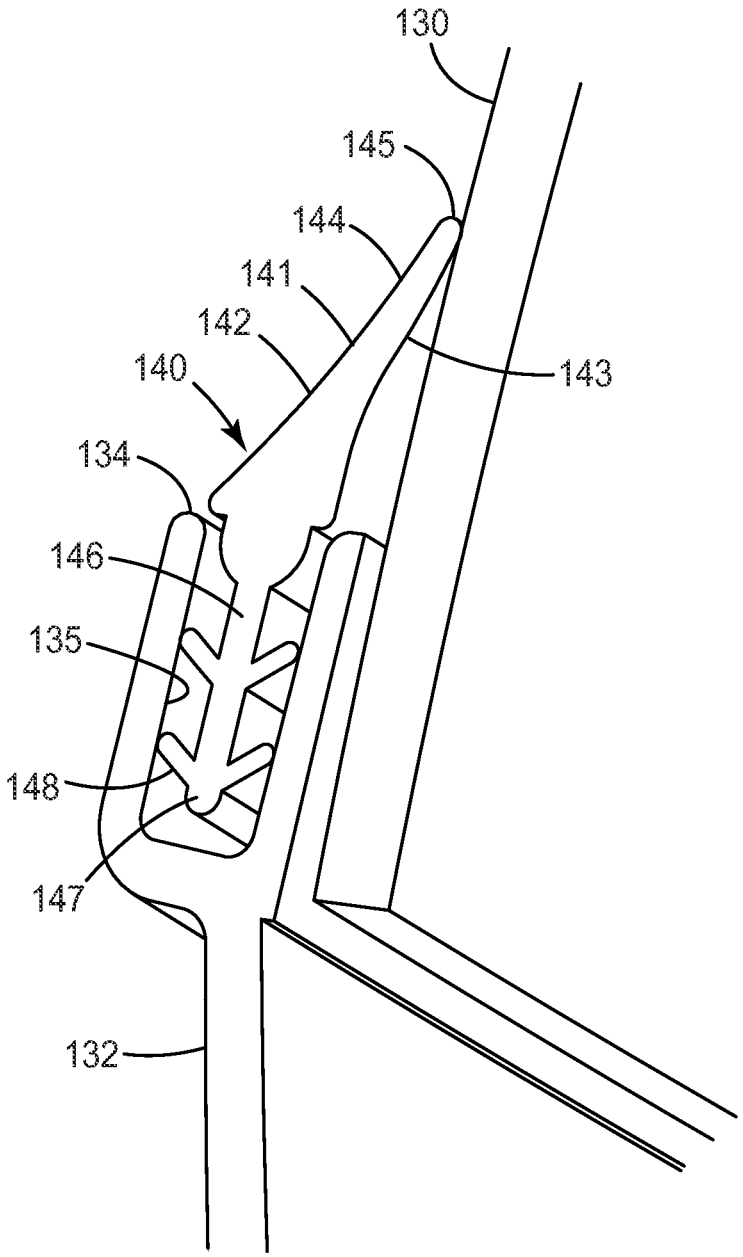
FIG. 5 is an enlarged perspective side view of a portion of a headgear article according to the present disclosure, focusing on the seal and its engagement with the lens and head-covering article.

Referring to FIG. 5, an enlarged perspective side view of a face shield engagement with generic head covering article is shown. This face shield and head covering article may be from any of the headgear discussed above (i.e., hardhat respirator system 100, helmet respirator system 110 and visor respirator system 120) or from another exemplary article of headgear. Illustrated is headgear having a surface 130 with a lens 132 making a sealed connection thereto by seal 140 present at edge 134 of lens 132. Exemplary lens 132 includes a groove 135 for receiving a part of seal 140 therein. Seal 140 may represent any or all of seal 25, seal 55, and seal 85.

In an exemplary embodiment, seal 140 includes a body 142 having a length L (FIG. 4) that has a sealing portion 144 and an attachment portion 146 extending the length L. Sealing portion 144 includes a sealing surface 143 at least proximate a distal end 145 of body 142 that, when disposed against surface 130 of the headgear, creates a seal, e.g., a fluid tight seal, with surface 130. Opposite sealing surface 143 is an opposite, upper surface 141. Upper surface 141 is configured to facilitate the removal of solid (e.g., particulate) contaminants from the headgear by providing a surface from which the contaminants can readily slide off when lens 132 is in its lowered position. In some embodiments, upper surface 141 provides a smooth transition from head covering article surface 130 to lens edge 134.

In this embodiment, the attachment of seal 140 to lens 132 is a mechanical attachment via attachment portion 146, which includes a stem 147 with one or more projections, such as a plurality of barbs 148 extending therefrom. In most embodiments, attachment portion 146 is press-fit into groove 135, without the use of secondary attachment systems such as clips, pins, screws, or the like. In some exemplary embodiments, seal 140 may be removably received in groove 135 of lens 132 or otherwise removably attached to lens 132 or the face shield. In some embodiments, the seal is attached to the lens after pivotally connecting the lens to the head-covering article, whereas in other embodiments the seal is attached to the lens prior to connecting the lens to the head-covering article.

As seen best in FIG. 4, seal 85 follows the shape of both lens 82 and frontal surface 75. In typical embodiments, seal 85 is curved along its length L; e.g., seal 85 has an arcuate shape. In some embodiments, seal 85 is not semi-circular, but is a portion of an ellipse (e.g., seal 85 is elliptical) or other shape having a non-constant radius. Although not discernible in FIG. 5, seal 140 may be configured to follow the shape of surface 130 and lens 132. In some exemplary embodiments, the seal 140 may have a curved shape, as previously described. Various embodiments are provided below in this disclosure of seals that inhibit puckering when formed to a radiused shape, such as a curved shape. Also provided below are various embodiments of seals that may be configured to sealingly conform to a radiused surface, such as a curved surface 130, when mounted to a radiused lens, such as a curved lens 132. The seals engage their sealing surface with relatively minimal puckering that might otherwise provide an unsealed area. In some embodiments, there is no puckering.

The seals of this disclosure (e.g., seals 25, 55, 85, 140, etc.) can be formed from a flexible, conformable, and generally polymeric material. The seals can be made from a variety of materials including, e.g., organic polymers, inorganic polymers, metals, composites of organic polymers, and combinations thereof. Examples of suitable polymeric materials include thermoplastic and thermosetting materials. Suitable thermoplastic polymer materials include polyesters, polyurethanes, polystyrenes, polyolefins, polystyrene, polyperfluoro olefins, vinyls and polyvinyl chlorides, nylons, and copolymers thereof. Suitable thermosetting polymers include epoxies, polyimides, polyesters, silicones, and copolymers thereof (i.e., polymers containing at least two different monomers including, e.g., terpolymers and tetrapolymers). Elastomers are particularly suitable for seals of this disclosure. Examples of elastomers or elastomeric materials include styrene-butadiene copolymer, polychloroprene (neoprene), nitrile rubber, butyl rubber, polysulfide rubber, polyisoprene, ethylene-propylene terpolymers (EPDM rubbers), silicone rubber, and polyurethane rubber. Rubber (e.g., natural rubber) is also a suitable material.

In most embodiments, seal 140 is extruded. Because of the manufacturing technique (i.e., extrusion), a typical seal is generally straight and non-directional, typically not having a tendency to curl or bend beyond normal manufacturing tolerances. Prior to the various embodiments in according to this disclosure, bending an extruded piece (e.g., a seal) to follow a desired radius usually resulted in puckering, which is not conducive to a fluid-tight seal. The present disclosure provides various embodiments of extruded seals that readily form to a curved shape and/or that sealingly conform to a curved surface.

Figure 6:
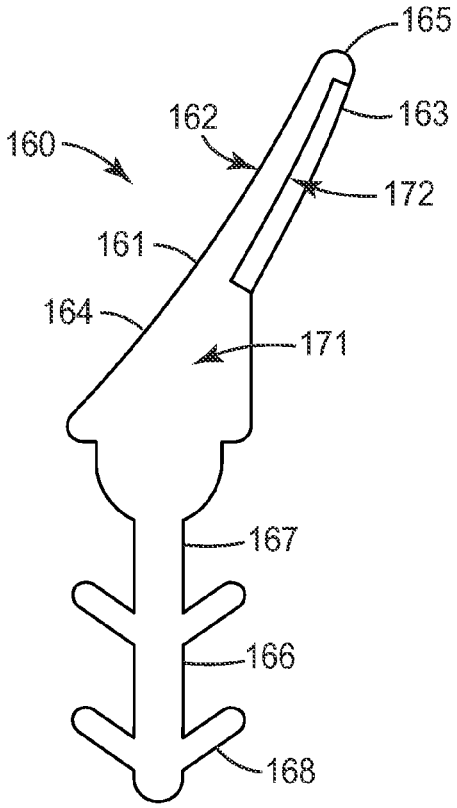
FIG. 6 is an end view of another embodiment of a seal according to the present disclosure.

A first embodiment of a seal that readily forms a curved shape and/or that sealingly conforms to a curved surface is illustrated in FIG. 6. This seal 160 has a body 162 that has a sealing portion 164 and an attachment portion 166. Sealing portion 164 includes a sealing surface 163 at least proximate a distal end 165 of body 162 that, when disposed against a curved surface, can create a seal, e.g., a fluid tight seal, with the surface. Opposite sealing surface 163 is an opposite, upper surface 161. Attachment portion 166 includes a stem 167 with one or more projections, such as plurality of barbs 168 extending therefrom. When positioned in a curved shape, e.g., whether in a groove of a curved face shield lens and/or against a curved headgear surface, the inner surface of body 162 (e.g., sealing surface 163) is shorter than the opposite, outer surface of body 162.

To facilitate bending seal 160 to the curved shape, seal 160 may be composed of two different materials; a first material 171 and a second material 172. First and second materials 171, 172 are selected to have different tensile moduli. In one embodiment, a relative tensile modulus between the two materials is at least about 3×, at least about 5× in some embodiments, and in some other embodiments, at least about 10×. Tensile modulus is related to the hardness or durometer of a material. Durometer is a measurement of the relative hardness of an elastomeric material. Two durometer scales exist, which have some overlap: Shore A for the very softest of rubbery materials (e.g., skin or silicone caulk), and Shore D. Examples of materials measured in the Shore A scale include door weather-stripping materials and examples of materials measured in the Shore D scale include solid tires (e.g., on a lawn mower or caster wheels).

In this embodiment, first material 171 has a lower durometer than second material 172. Also in this embodiment, first material 171 has a lower tensile modulus than second material 172. In this embodiment, second material 172 is proximate sealing surface 163. First material 171, present in attachment portion 166 and the outer surface of body 162, is more stretchable and conformable than second material 172. When seal 160 is bent (so that sealing surface 163 is an inner surface of a curved shape), second material in sealing portion 164 bends and conforms to the desired shape. First material 171 in sealing portion 164 and in attachment portion 166 stretches to accommodate the longer length that results when sealing portion 164 is curved around front surface area 15, 45, 75.

An exemplary embodiment of a seal, such as seal 160, has an overall height of about 0.5 inch (about 1.27 cm), with the sealing portion 164 being about 0.3 inch (about 0.76 cm) and the attachment portion 166 being about 0.23 inch (about 0.58 cm). Sealing portion 164 is tapered and very slightly curved; sealing surface 163 is defined by a radius of about 0.9 inch (about 2.3 cm), and upper surface 161 is defined by a radius of about 0.6 inch (about 1.5 cm). At distal end 165, the thickness of sealing portion 164 is about 0.024 inch (about 0.6 mm), and that thickness gradually increases to a thickness of about 0.045 inch (about 1.14 mm) prior to flaring to 0.117 inch (about 3 mm) at attachment portion 166.

In an exemplary embodiment, present within sealing portion 164 is an insert of second material 172, which is about 0.02 inch (about 0.5 mm) thick and 0.185 inch (about 4.7 mm) long. The overall width or thickness of attachment portion 166 is about 0.110 inch (about 2.8 mm), with the thickness of stem 167 about 0.03 inch (about 0.76 mm) with four barbs 168, each about 0.018 inch (about 0.45 mm) thick, extending from stem 167. Seal 160 is intended to be used with headgear such as respirator systems 100, 110, 120. In one embodiment, seal 160 is about 12 inches (about 30.5 cm) long and conforms to an elliptical shape (best seen in FIG. 2) having a minimum radius of about 2.93 inches (about 7.44 cm) and a maximum radius of about 7.3 inches (about 18.5 cm).

One or both of the first material and the second material could be a polyolefin-based thermoplastic elastomer. In a first variant of this example, first material 171, having the lower durometer, is SANTOPRENE™ TPV 101-55 polyolefin-based thermoplastic elastomer from Exxon Mobil Chemical, having a Shore A hardness of 59-64. Second material 172 is SANTOPRENE™ TPV 223-50 polyolefin-based thermoplastic elastomer from Exxon Mobil Chemical, having a Shore D hardness of 51. For these materials, the relative tensile modulus is about 12.3×. Particular properties of these two materials are provided below:

Santoprene TPV 101-55
Durometer: Shore A 59
Durometer range Shore A 45 to 65
Examples of similar durometer parts: automotive radiator hose, pneumatic auto tire tread
Linear tensile modulus: 2,365 psi
Santoprene TPV 223-50
Durometer: Shore D 51
Durometer range Shore D 45 to 55
Examples of similar durometer parts: molded electrical cable ends, solid tires
Linear tensile modulus: 29,095 psi In a second variant of this example, first material 171, having the lower durometer, is either SANTOPRENE™ TPV 101-55 polyolefin-based thermoplastic elastomer, or SANTOPRENE™ TPV 223-50 polyolefin-based thermoplastic elastomer. Second material 172 is a polypropylene; one particular polypropylene, PRO-FAX™ 7823 polypropylene from LyondellBasell has a tensile modulus of about 86,700 psi. In this example, the relative tensile modulus is about 36× for Santoprene TPV 101-55, and about 3× for Santoprene TPV 223-50.

In a variant embodiment of seal 160, first and second materials 171, 172 may be selected based on relative curing qualities (i.e., from a molten to a solid phase) of the materials. A material for second material 172 could be selected that shrinks or contracts upon curing, relative to first material 171. With such materials, first material 171 in sealing portion 164 and in attachment portion 166 maintains the longer length needed by the outer surface of the curved seal than needed by sealing surface 163 and second material 172.

Figure 7:
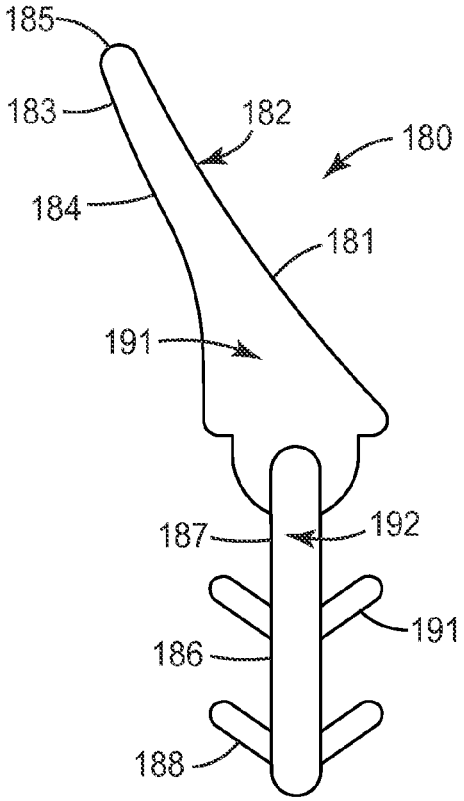
FIG. 7 is an end view of yet another embodiment of a seal according to the present disclosure.

A second embodiment of a seal that readily forms a curved shape and/or that sealingly conforms to a curved surface is illustrated in FIG. 7. This seal 180 has a body 182 that has a sealing portion 184 and an attachment portion 186. Sealing portion 184 includes a sealing surface 183 at least proximate a distal end 185 of body 182 that, when against radiused surface, creates a seal, e.g., a fluid tight seal, with the surface. Opposite sealing surface 183 is an upper surface 181. Attachment portion 186 includes a stem 187 with one or more projections, such as a plurality of barbs 188 extending therefrom. When positioned in a curved shape, e.g., whether in a groove of a curved face shield lens and/or against a curved headgear surface, the inner surface of body 182 (e.g., sealing surface 183) is shorter than the opposite, outer surface of body 182.

To facilitate bending seal 180 to the curved shape, seal 180 is composed of two different materials; a first material 191 and a second material 192. In this embodiment, first material 191 has a lower durometer than second material 192. In a variant embodiment, first material 191 has a lower tensile modulus than second material 192. In this embodiment, second material 192 forms at least a portion of stem 187 of attachment portion 186. First material 191, present in sealing portion 184 and barbs 188, is more stretchable and conformable than second material 192. When seal 180 is bent (so that sealing surface 183 is an inner surface of a curved shape), second material 192 in stem 187 bends and conforms to the desired shape. First material 191 in sealing portion 184 stretches, contracts or otherwise deforms to accommodate the shape and dimensions needed. In some embodiments, seal 180 may be thermally post-processed to improve the sealing engagement to a curved surface, e.g., to surface 130.

An exemplary embodiment of a seal, such as seal 180, has an overall height of about 0.5 inch (about 1.27 cm), with the sealing portion 184 being about 0.3 inch (about 0.76 cm) and the attachment portion 186 being about 0.23 inch (about 0.58 cm). Sealing portion 184 is tapered and very slightly curved. Sealing surface 183 is defined by a radius of about 0.9 inch (about 2.3 cm), and upper surface 181 is defined by a radius of about 0.6 inch (about 1.5 cm). Sealing portion 184 has a thickness of about 0.024 inch (about 0.6 mm) at distal end 185 that increases gradually to a thickness of about 0.045 inch (about 1.14 mm) prior to flaring to 0.117 inch (about 3 mm). Stem 187, of second material 192 has a thickness of about 0.03 inch. Four barbs 188 of first material 191 extend about 0.04 inch (about 1 mm) from stem 187.

One or both of the first material and the second material could be a polyolefin-based thermoplastic elastomer. In this embodiment, first material 191, having the lower durometer, is SANTOPRENE™ TPV 101-55 polyolefin-based thermoplastic elastomer and second material 192 is SANTOPRENE™ TPV 223-50 polyolefin-based thermoplastic elastomer, described above.

An alternate exemplary embodiment of the seal described above, has first material 191 as the lower durometer, SANTOPRENE™ TPV 101-55 polyolefin-based thermoplastic elastomer and second material 192 as PRO-FAX™ 7823 polypropylene.

In another embodiment, not specifically illustrated, a seal similar to seal 180 includes a thin layer (0.003 inch (about 0.07 mm) thick) of SANTOPRENE™ TPV 223-50 thermoplastic elastomer across sealing surface 183 of sealing portion 184.

In a variant embodiment of seal 180, first and second materials 191, 192 may be selected based on relative rigidity of the materials. A material for second material 192 could be selected that is more rigid than first material 191 when in the cured state. With such materials, the more rigid material 192 facilitates the insertion and engagement of attachment portion 186 with the lens, e.g., into groove 135 of FIG. 5, while the less rigid material 191 in sealing portion 184 better conforms to the curved headgear.

Seal 160, 180 and other embodiments may be co-extruded, with both first material 171, 191 and second material 172, 192 shaped by the same extruder and die. The two materials 171, 191, 172, 192 may be extruded simultaneously or sequentially within the same extruder and die. Alternately, seal 160, 180 may be extruded using an insert-extrusion technique, where an insert (e.g., second material 172, 192) is provided in its final shape and the remainder of seal 160, 180 (e.g., first material 171, 191) is extruded around the insert.

In yet another embodiment, a seal, e.g., seal 140 of FIG. 5, is formed from a single polymeric material that is post-processed after extrusion. As discussed above, after extrusion of a seal, the seal usually has a straight, non-directional orientation. To impart a desired curvature to the seal, the seal can be thermoformed (i.e., heated) to create a curved or arcuate shape. The thermoforming can be done by immersing the entire seal in heat (e.g., in an oven or water bath) or by directing controlled heat (e.g., by a heat gun). Seals composed of at least two materials, e.g., seals 160, 180, could also be post-processed after extrusion.

As one example of post-processing, an extruded seal, optionally cut to the desired length, is placed in a holder that replicates the desired curvature of the final product. The holder includes a groove that generally matches the curvature of groove 135 of lens 132. After placing the untreated seal into the holder, sealing portion 144 may have a rippled, puckering shape proximate tip 145. A hot air gun (heating air to approximately 350° F.) may be swept back and forth across the rippled, flexible tip 145 for approximately 10 to 15 seconds until the ripples disappear. The heated piece can be removed after cooling from the fixture plate. The resulting seal retains the approximate curvature of the holder and exhibits essentially no ripples or reduced ripples.

Thus, embodiments of the LENS SEAL FOR HEADGEAR are disclosed. One skilled in the art will appreciate that the present disclosure can be practiced with embodiments other than those disclosed. The disclosed embodiments are presented for purposes of illustration and not limitation, and the present invention is limited only by the claims that follow.

What is claimed is:

1. An article of headgear comprising:

a head-covering article;

a lens moveably attached to the head-covering article by a frame; and a seal attached to the lens, the seal comprising a first polymeric material and a second polymeric material, the first polymeric material having a greater tensile modulus than the second material;

wherein the lens is moveable from a first, lowered position to a second, raised position, and when in the first, lowered position, the seal engages the head covering article.

2. The article of claim 1, wherein the tensile modulus of the first polymeric material is at least about 5× greater than the tensile modulus of the second material.

3. The article of claim 1, wherein each of the first polymeric material and the second polymeric material is a polyolefin-based thermoplastic elastomer.

4. The article of claim 1, wherein the seal comprises a sealing portion and an attachment portion, and the second material is present in the sealing portion.

5. The article of claim 4, wherein the second material is present on a surface of the sealing portion.

6. The article of claim 1, wherein the seal comprises a sealing portion and an attachment portion, and the second material is present in the attachment portion.

7. The article of claim 1, wherein the lens comprises a groove therein, with an attachment portion of the seal inserted into the groove.

8. The article of claim 7, wherein the attachment portion of the seal is mechanically anchored in the groove.

9. The article of claim 1 wherein the seal is removably attached to the lens.

10. An article of headgear comprising:

a head-covering article;

a lens moveably attached to the head-covering article by a frame, the lens having a curve associated therewith;

a seal attached to the lens, the seal being curved and comprising a first polymeric material and a second polymeric material, the first polymeric material having a greater tensile modulus than the second material;

wherein the lens is moveable from a first, lowered position to a second, raised position, and when in the first, lowered position, the seal engages the head covering article.

11. The article of claim 10, wherein the curved seal comprises a sealing portion and an attachment portion, and the second material being present in the sealing portion.

12. The article of claim 11, wherein the second material is present on a surface of the sealing portion that faces the head-covering article.

* * * * *